US008333029B1

(12) United States Patent
Noveske

(10) Patent No.: US 8,333,029 B1
(45) Date of Patent: Dec. 18, 2012

(54) EXTREME DUTY MACHINE GUN BARREL

(76) Inventor: John Noveske, Grants Pass, OR (US)

( * ) Notice: Subject to any disclaimer, the term of this patent is extended or adjusted under 35 U.S.C. 154(b) by 140 days.

(21) Appl. No.: 13/065,207

(22) Filed: Mar. 16, 2011

Related U.S. Application Data

(63) Continuation-in-part of application No. 12/005,984, filed on Dec. 28, 2007, now abandoned.

(60) Provisional application No. 60/899,784, filed on Feb. 5, 2007.

(51) Int. Cl.
*F41A 21/18* (2006.01)

(52) U.S. Cl. ..... 42/76.1; 42/78; 89/14.8; 89/14.7

(58) Field of Classification Search ..... 42/76.1, 42/76.02, 78; 89/14.8, 14.7, 16
See application file for complete search history.

(56) References Cited

U.S. PATENT DOCUMENTS 1,316,509 A * 9/1919 Rose ..... 42/76.1
2,848,401 A * 8/1958 Hartley ..... 205/652
6,564,689 B1 * 5/2003 Billgren ..... 89/16

* cited by examiner

*Primary Examiner* — Stephen M Johnson
(74) *Attorney, Agent, or Firm* — Bennet K. Langlotz; Langlotz Patent & Trademark Works, Inc.

(57) ABSTRACT

An extreme duty machine gun barrel has body having a central bore. The rear opening of the body includes a chamber formed to receive a cartridge. The body has a surface layer covering all surfaces of the body. The body has a diffusion layer extending below the surface layer into an underlying material of the body. The central bore may have rifling defined by lands and grooves formed in the bore. An interior portion of the body may have a hardness of at least 50 HRC and not greater than 55 HRC after the surface layer and diffusion layer are created on the body. The surface layer and diffusion layer may be created by subjecting the body to a ferritic nitrocarburizing treatment followed by an oxy nitrocarburizing treatment. The nitrocarburizing treatments may be repeated. The body may be AISI H13 grade tool steel.

22 Claims, 4 Drawing Sheets

EXTREME DUTY MACHINE GUN BARREL

CROSS-REFERENCE TO RELATED APPLICATION

The present application claims priority to and is a continuation-in-part of U.S. patent application Ser. No. 12/005,984, now abandoned, entitled "NOVESKE RIFLEWORKS EXTREME DUTY MACHINE GUN BARREL," filed Dec. 28, 2007, which claims priority to U.S. Provisional Patent Application Ser. No. 60/899,784, entitled "NOVESKE RIFLEWORKS EXTREME DUTY MACHINE GUN BARREL," filed Feb. 5, 2007.

FIELD OF THE INVENTION

The invention relates to firearms, and more particularly to a gun barrel that is manufactured to withstand temperatures exceeding 800° F. during the course of an extended firing schedule.

BACKGROUND OF THE INVENTION

Gun barrels are traditionally manufactured from various steel alloys. Lining the gun barrels with various other materials to provide enhanced corrosion resistance, increased projectile velocity, and lengthened service life has been a routine practice for small arms for over 100 years.

Increased use of hotter burning gunpowder to increase projectile performance and fully automatic firing to increase rounds per minute cause gun barrels to reach temperatures exceeding 800° F. Maintaining gun barrel integrity and minimizing erosion to prolong gun barrel life has become very challenging under these conditions.

416 Society of Automotive Engineers (SAE) grade stainless steel has been used for gun barrels to prevent corrosion, but is generally not as well suited for use as a gun barrel compared to 4140 SAE grade and 4150 SAE grade chromoly steels. Chromoly steels provide better strength at the high temperatures reached during extended periods of fully automatic firing, which makes them very popular for use in military small arms such as the M-16 rifle.

Unfortunately, chromoly steels are vulnerable to corrosion and rapid erosion. Barrel bore rusting caused weapon malfunctions during the Vietnam War because the 4150 SAE grade chromoly steel barrels rusted in the humid environment. It was also learned that the high-pressure projectile fired by the M-16 rapidly eroded the chamber of the barrel. A chrome lining was applied to the barrel in order to extend the weapon's surface life.

Chrome-lined barrels present several of their own problems, though. First, it is very difficult to apply the chrome evenly in large production runs. Inconsistent application adversely affects the rifle's accuracy. Chrome lining also prevents the barrel from operating at temperatures exceeding 800° F. for any prolonged period of time, which limits the number of rounds that can be fired before the gun barrel must be permitted to cool. Otherwise, the barrel will lose its temper quickly, resulting in erosion of the barrel chamber and firearm malfunctions.

Other linings, such as the one described in U.S. Pat. No. 7,197,986, have been proposed, but they do nothing to increase the strength of the barrel at higher temperatures. The coating described is limited to protecting the chamber and rifling of the barrel. However, when a firearm is operated for long periods of time at high temperatures, preserving the temper of the barrel itself is the primary problem that must be overcome.

Alternative barrel materials, such as the composite gun barrel described in U.S. Pat. No. 6,889,464, provide a lightweight alternative to steel that cools faster than a standard gun barrel. Unfortunately, the resins used in the gun barrel's construction are not suitable for sustained high rates of fire. Eventually, the high heat generated causes the resin to break down, rendering the gun barrel unusable.

It is therefore an object of this invention to provide a gun barrel that maintains its temper and has increased corrosion resistance for extended operation of fully automatic firearms.

SUMMARY OF THE INVENTION

The present invention provides an improved gun barrel, and overcomes the above-mentioned disadvantages and drawbacks of the prior art. As such, the general purpose of the present invention, which will be described subsequently in greater detail, is to provide an improved gun barrel that has all the advantages of the prior art mentioned above.

To attain this, the preferred embodiment of the present invention essentially comprises a body having a central bore including a front opening and a rear opening. The rear opening of the body includes a chamber formed to receive a cartridge. The body has a surface layer covering all surfaces of the body. The body has a diffusion layer extending below the surface layer into an underlying material of the body. The central bore may have rifling defined by lands and grooves formed in the bore. An interior portion of the body may have a hardness of at least 50 HRC and not greater than 55 HRC after the surface layer and diffusion layer are created on the body. The surface layer and diffusion layer may be created by subjecting the body to a ferritic nitrocarburizing treatment followed by an oxy nitrocarburizing treatment. The nitrocarburizing treatments may be repeated. The body may be AISI H13 grade tool steel.

There are, of course, additional features of the invention that will be described hereinafter and which will form the subject matter of the claims attached.

There is thus been outlined, rather broadly, the more important features of the invention in order that the detailed description thereof that follows may be better understood and in order that the present contribution to the art may be better appreciated.

DESCRIPTION OF THE CURRENT EMBODIMENT

Figure 1:
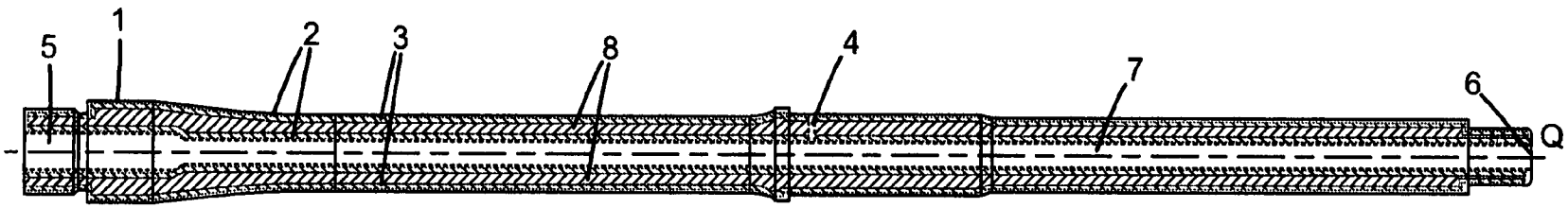
FIG. 1 is a side sectional view of a gun barrel constructed in accordance with the principles of the present invention.

A preferred embodiment of the gun barrel of the present invention is shown and generally designated by the reference numeral 1.

Figure 2:
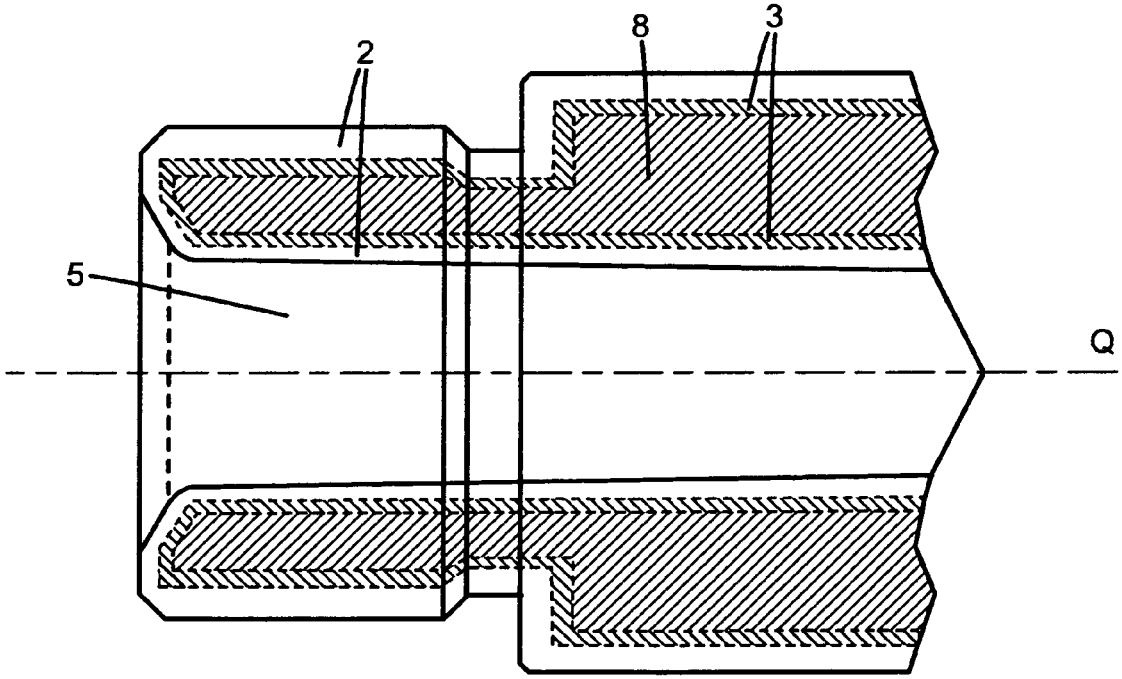
FIG. 2 is an enlarged fragmentary view of FIG. 1 showing the chamber.
Figure 3:
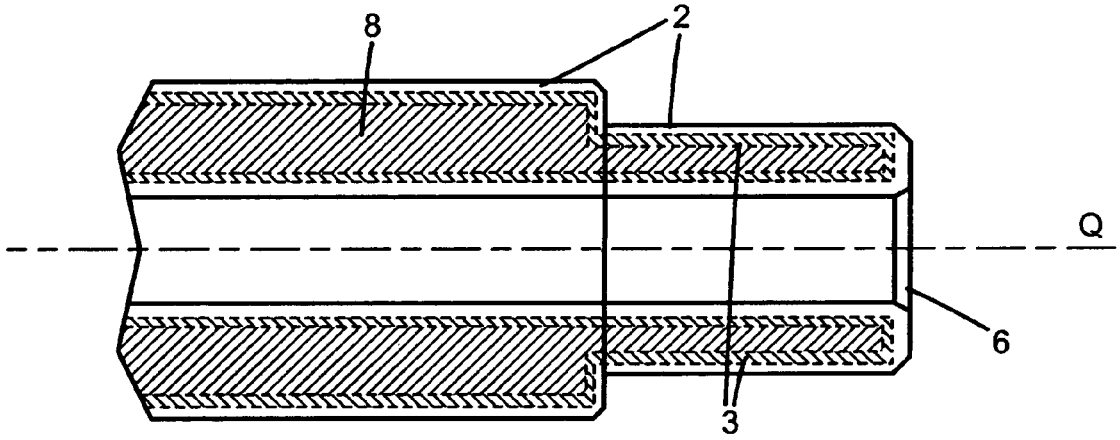
FIG. 3 is an enlarged fragmentary view of FIG. 1 showing the muzzle.

As used in the specification, the word "front" or "forward" corresponds to the firing direction of the firearm (i.e., to the right as shown in FIGS. 1, 2, and 3); "rear" or "rearward" or "back" corresponds to the direction opposite the firing direction of the firearm (i.e., to the left as shown in FIGS. 1, 2, and 3); "longitudinal" means the direction along or parallel to the longitudinal axis a of the barrel of the firearm; and "transverse" means a direction perpendicular to the longitudinal direction.

FIG. 1 illustrates the improved gun barrel 1 of the present invention from the side. More particularly, the gun barrel has a breech end 5, a muzzle end 6, an inner and outer black oxide surface layer 2, a diffusion layer 3, and a core 8. The gun barrel has a central longitudinally extending bore 7, which may be internally rifled. The black oxide surface layer covers all surfaces of the gun barrel, including the interior of the gas port 4, and has a preferred thickness of about 0.001 inch. The thin black oxide surface layer does not materially affect the dimensions of the gun barrel.

The diffusion layer 3 extends from the outer black oxide surface layer into the underlying material of the gun barrel. The diffusion layer extends beneath the black oxide surface layer beginning at a depth of 0.001 inch from the surface of the gun barrel for about an additional 0.015 inches. This is in contrast to a surface coating, which does not affect the underlying barrel material. A core 8 of non-nitrided, but still hardened, material is located in the interior of the gun barrel between the diffusion layers.

In the current embodiment, the gun barrel is an M4 carbine gun barrel manufactured from American Iron and Steel Institute (AISI) H13 grade tool steel. Alternative hard refractory materials commonly referred to as tool steels, such as any other AISI H-grade tool steel, any AISI M-grade tool steel, and any AISI T-grade tool steel, can also be used.

FIGS. 2 & 3 illustrate the chamber 5 and muzzle 6, respectively, of the improved gun barrel 1 of the present invention. More particularly, the black oxide surface layer provides continuous protection to the surfaces of the gun barrel. The diffusion layer 3 extends beneath the black oxide surface layer. The non-nitrided core 8 is present between the diffusion layers.

Figure 4:
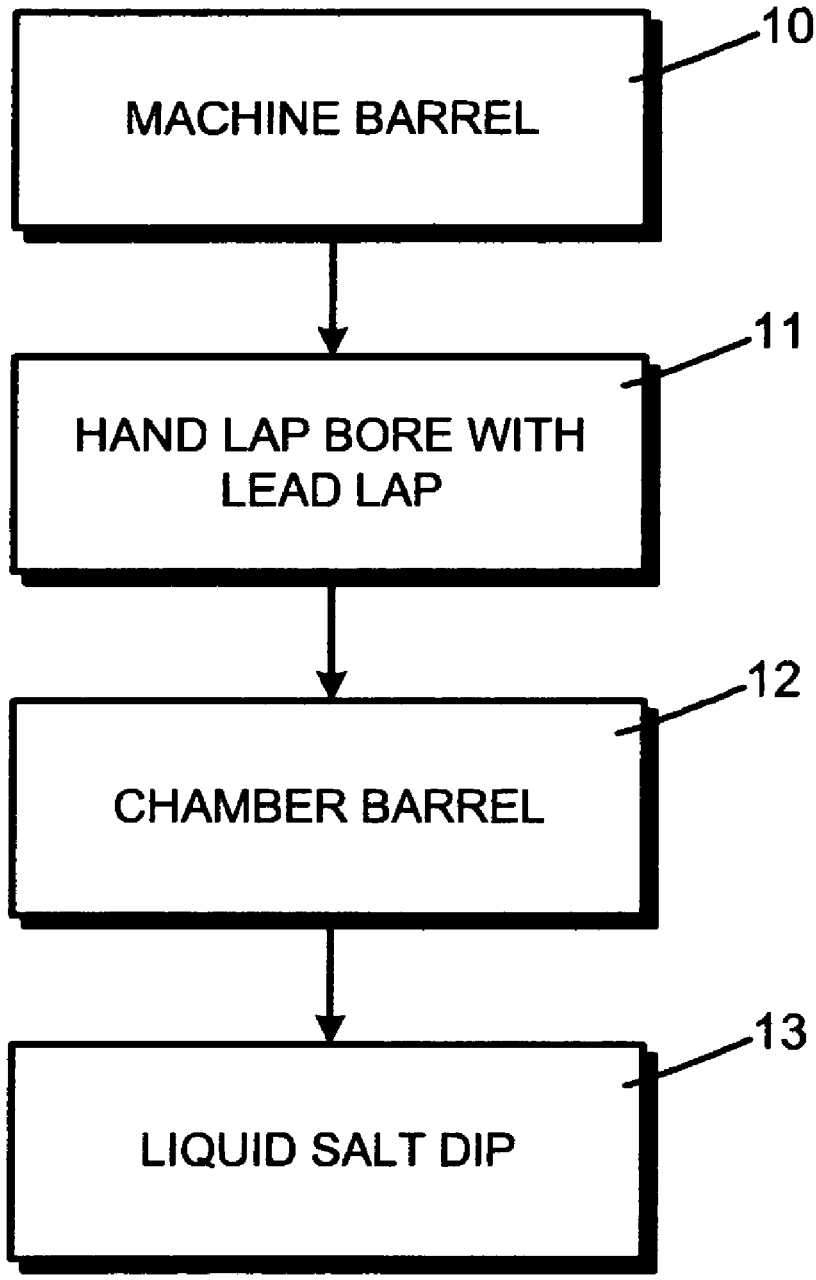
FIG. 4 is a flow diagram illustrating the steps to manufacture the gun barrel shown in FIG. 1.

FIG. 4 is a flow diagram that illustrates the steps to manufacture the gun barrel shown in FIG. 1. The manufacturing process begins with the step of machining the barrel (10). In this step, the AISI H13 grade tool steel bar stock is first hardened from an initial hardness of approximately 20-24 Rockwell hardness (HRC) to 27.5 HRC. The hardening is accomplished by a heat treatment. Hardening the H13 grade tool steel before machining it is counterintuitive because softer AISI H13 grade tool steel is significantly easier to machine for most applications. However, standard AISI H13 grade tool steel bar stock was found to be too soft for gun barrel machining. The softer steel turned out to be sticky and adhered to some of the tooling. The resulting buildup was capable of breaking tooling and also caused the steel to be ripped instead of cleanly cut by the cutting edge of the tooling. These obstacles were eliminated by hardening the steel to 27.5 HRC before machining it.

After the initial hardening, the bar of steel are cut to the desired length (28 inches to produce two M4 carbine barrels), gun drilled, and bore reamed. During the deep hole gun drilling process, the barrel is spun on its longitudinal axis at about 3500 revolutions per minute while a non-rotating carbide-tipped drill is fed at 1⅛ inches per minute into the center of the barrel. The drill is specially ground to a profile (20° outside/quarter, 30° inside/half) that seeks the gravitational center of the spinning steel bar so the resulting hole is registered with the longitudinal axis of the barrel. Cuttings from the barrel are cleared by a high-pressure flow of oil that passes through the hollow core of the drill. Alternatively, the bar of steel can be stationary and the drill can rotate during the deep hole gun drilling process.

Once the drill has passed completely through the barrel, the barrel is placed in a bore reaming machine and mounted in a stationary position. The bore reamer is placed through the hole previously drilled in the center of the barrel, spun at 500 revolutions per minute, and pulled through the barrel at a linear speed of about 1.5 in. per minute. The cuttings are cleared from the barrel by a pressurized cutting oil supply that passes through the hollow core of the bore reamer. These actions complete the step of machining the barrel (10) and form a bore that is registered with the longitudinal axis of the barrel.

After the barrel has been machined, the bore is hand lapped in step (11) using a lead lap impregnated with aluminum oxide particles to remove any tooling marks left behind by the bore reaming process. The barrel is then cleaned with solvents and dried prior to being mounted in a button rifling machine. Step (11) is completed by button rifling the bore to create lands and grooves, performing another hand lapping, and turning the gun barrel on a lathe to finish the gun barrel's external dimensions.

During button rifling, an oversized button is pulled through the barrel by the hydraulic piston of the button rifling machine. The button is an oval-shaped piece of hardened carbide with a desired amount of equally spaced relief cuts around its major diameter. These cuts are voids to allow the bore diameter turning the same wildly oval major diameter pushes the steel into a new groove diameter. The button is rotated by guide on the button rifling machine to provide the desired twist per foot. Once the button has passed completely through the barrel, the lands are left behind at the previous bore diameter, resulting in the barrel having a rifled center. Alternatively, hammer-forged or cut rifling can be used instead of button rifling.

The second hand lapping in step (11) also uses a lead lap impregnated with aluminum oxide particles and orients the land and groove surfaces with the helical twist of the rifling. This step of the process ensures that the projectile will not experience mechanical abrasion as it travels down the bore. The lapping process is also a critical preparatory phase for the surface conversion process that occurs when the black oxide surface layer is created.

In step (12) the barrel is chambered by a five-blade carbide reamer at approximately 400 RPM. The feed rate is approximately ½ inch per minute. This is accomplished by removing material from the rear of the barrel to create a negative of a firearm cartridge. A cartridge is an assembled unit consisting of a casing, primer, propellant, and projectile. The barrel is now ready for hardening and tempering.

Finally, in step (13), the barrel is subjected to a surface conversion process that also tempers the hardened barrel. First, the barrel is preheated in air at a temperature between 650° F.-750° F. for 30 minutes. This initial heating prevents any thermal shock to the barrel as the barrel is lowered into the Austenitize process, which heats the barrel to 1850° F. for 120 minutes. Austenitization means to heat the iron, iron-based metal, or steel to a temperature at which it changes crystal structure from ferrite to austenite. Austenite, also known as gamma phase iron, is a metallic non-magnetic allotrope of iron or a solid solution of iron, with an alloying element.

The barrel is then moved to a nitriding bath for a time of 90 minutes at a set temperature of 1070° F. In the current embodiment, a ferritic nitrocarburizing process using a salt bath of alkali cyanate is employed. However, any suitable nitriding technique that imparts a diffusion layer to the barrel could be used. The cyanate thermally reacts with the surface of the work piece to form alkali carbonate. The bath is then treated to convert the carbonate back to a cyanate. The surface formed from the reaction has a compound (surface) layer and a diffusion layer. The compound layer consists of iron, nitrogen, and oxygen, is abrasion resistant, and stable at elevated temperatures. The diffusion layer contains nitrides and carbides.

After the first nitriding process is complete, the barrel is cooled in an oxidative cooling bath with a set temperature of 825° F. for 10 minutes to undergo oxy nitrocarburizing. The barrel is then returned to the nitride bath for 90 minutes at 1070° F. followed by another 10 minutes in the oxidative cooling bath at 825° F. At the conclusion of the baths, the barrel has undergone two ferritic nitrocarburizing treatments and two oxy nitrocarburizing treatments.

The final cooling bath allows the barrel to cool before the barrel is placed in the water cleaning stage of the process. Also, oxidation takes place on the surface of the components by forming a thin iron oxide layer on the compound layer and sealing the pores that are opened during the nitriding process with oxide. This oxide layer produces the black coloration of the gun barrel.

The barrel is then raised from the oxidation bath and allowed to air cool for an average time of 10-20 minutes before being lowered into a water rinse.

The water rinse stage is used to clean the oxidation bath residue from the barrel and cool the barrel further. This stage is typically a 15-20 minute process.

Cleaning is performed in an additional water rinse for a minimum of 30 minutes.

The barrel is then dipped in a post process oil treatment for even more enhanced corrosion resistance to complete step (14).

The resulting black oxide surface layer has a hardness of at least 68 HRC and not greater than 72 HRC. This range of hardness provides the desired level of resistance to wear without being too brittle. The black oxide surface layer is 2 points harder than a chrome coating, which makes the surface layer more durable than a chrome coating. In addition, the surface the bullet contacts has much more similar properties to the other material comprising the barrel than a chrome coating does to conventional gun barrel steel. The black oxide surface layer has a similar thermal expansion rate to the underlying H13 tool steel, so the surface layer is much less prone to breaking off in chunks as the gun barrel undergoes heating and cooling cycles compared to a hard chrome coating or a nitrided gun barrel made from a softer and more elastic material than H13 tool steel. H13 tool steel maintains integrity between the core material and the surface oxide layer. Other similar alloy tool steels can be used to provide a similar result. H13 tool steel is preferred because it retains hardness and wear resistance in extreme heat, even more so than other tool steels.

Nitriding a conventional gun barrel steel will cause chunks of the surface layer to break off from the underlying material because the surface layer is much harder than the host steel and cannot maintain structural integrity. Conventional gun barrel steel has much different thermal expansion rate than oxide surface layer.

The black oxide surface layer extends the service life of the gun barrel by protecting the surfaces of the chamber, the gun barrel's rifling, and the gas port and enhancing the gun barrel's corrosion resistance. The black oxide surface layer also reduces friction between the barrel chamber and a spent cartridge to reduce erosion of the chamber and facilitate cartridge extraction. The black oxide surface layer also reduces friction between the bore and a discharged projectile to reduce erosion of the bore. The surface layer makes the surfaces of the gun barrel wear resistant, lowers the coefficient of friction, and reduces tendencies for welding or seizing with other metallic parts.

The hardness of the diffusion layer 3 resulting from step (13) is a gradient from 68 to 72 HRC down to 50 to 55 HRC based on proximity to the core 8. The diffusion layer hardens the gun barrel to a deeper level to enable the gun barrel to maintain its temper at high temperatures. In fact, the gun barrel of the current invention can be operated at temperatures up to 1000° F. without losing its temper. This affords the user of the opportunity to use their firearm for firing schedules which would destroy or significantly reduce the useful life of other currently available barrels. Furthermore, even as the blackened oxide surface layer erodes, the lands in the bore are still harder at their core than either non-nitrided H13 or the lands of a hard chrome-lined gun barrel because of the diffusion layer. The diffusion layer is also more corrosion resistant than a hard chrome-lined gun barrel once the lining is worn away and the underlying barrel material is exposed.

As a result of step (13), the core of the wall of the barrel is hardened to a hardness of at least 50 HRC and not greater than 55 HRC. This is accomplished by the heat associated with the nitriding process. This range of hardness makes the gun barrel as hard as possible without becoming brittle. It gives the gun barrel sufficient rigidity and durability with desired elasticity. If the gun barrel were softer, it would be more susceptible to losing temper as it is heated to a high temperature during extreme rates of fire and then subsequently cooled.

Unless otherwise indicated, all steel grades referenced in the specification have the specified formulations designated by the United States Society of Automotive Engineers (SAE).

While a current embodiment of mounting system has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A process for manufacturing a gun barrel comprising the steps of:

obtaining a bar of tool steel having a longitudinal axis, a front, a rear, and an exterior surface;

hardening the bar of steel to a specified hardness;

cutting the bar of steel to a specified length;

drilling a hole through the bar of steel that is registered with the longitudinal axis of the bar of steel;

reaming a bore through the bar of steel that is registered with the longitudinal axis of the bar of steel, thereby defining an interior surface of the bar of tool steel encompassing the bore;

reaming a chamber in the rear of the bar of steel;

preheating the bar of steel;

heating the bar of steel to change the crystal structure of the bar of steel from ferrite to austenite;

nitriding the bar of steel to create an oxide layer on both the exterior and interior surfaces of the bar of steel and a diffusion layer beneath each of the oxide layers;

cooling the bar of steel;

rinsing the bar of steel; and cleaning the bar of steel; and wherein a core of the bar of steel located between the diffusion layers has been hardened to a hardness of at least 50 HRC and not greater than 55 HRC.

2. The process of claim 1 further comprising the step of dipping the bar of steel in oil.

3. The process of claim 1 further comprising the steps of:

lapping the bore;

cleaning the bar of steel with solvents;

drying the bar of steel;

rifling the bore; and lapping the rifled bore, wherein the step of lapping the bore occurs after the step of reaming a bore through the bar of steel and the step of lapping the rifled bore occurs before the step of reaming a chamber in the rear of the bar of steel.

4. The process of claim 3 wherein the step of rifling the bore comprises a process selected from the group comprising button rifling, hammer-forged rifling, and cut rifling.

5. The process of claim 1 wherein the step of drilling a hole through the bar of steel comprises spinning the bar of steel on its longitudinal axis at about 3000 revolutions per minute while feeding a non-rotating carbide-tipped drill into the center of the bar of steel.

6. The process of claim 1 wherein the step of reaming a bore through the bar of steel comprises placing a bore reamer through the hole drilled through the bar of steel, spinning the bore reamer at about 500 revolutions per minute, and pulling the bore reamer through the bar of steel at a linear speed of about 1.5 in. per minute.

7. The process of claim 1, wherein the tool steel is selected from the group comprising an AISI H-grade tool steel, an AISI M-grade tool steel, and an AISI T-grade tool steel.

8. The process of claim 1, wherein the step of hardening the bar of steel comprises hardening the bar of steel to about 27.5 HRC.

9. The process of claim 1, wherein the step of preheating the bar of steel comprises preheating the bar of steel in air at a temperature of at least 650° F. and not greater than 750° F. for about 30 min.

10. The process of claim 1, wherein the step of heating the bar of steel to change the crystal structure of the bar of steel from ferrite to austenite comprises subjecting the bar of steel to a temperature of about 1850° F. for about 120 min.

11. The process of claim 1, wherein the step of nitriding the bar of steel comprises the steps of:

ferritic nitrocarburizing the bar of steel; and oxy nitrocarburizing the bar of steel.

12. The process of claim 11, wherein the step of ferritic nitrocarburizing the bar of steel comprises subjecting the bar of steel to an alkali cyanate salt bath.

13. The process of claim 11, wherein the step of ferritic nitrocarburizing the bar of steel comprises subjecting the bar of steel to a temperature of about 1070° F. for about 90 minutes.

14. The process of claim 11, wherein the step of oxy nitrocarburizing the bar of steel comprises subjecting the bar of steel to a temperature of about 825° F. for about 10 minutes.

15. The process of claim 11, wherein the steps of ferritic nitrocarburizing the bar of steel and oxy nitrocarburizing the bar of steel are repeated multiple times prior to the step of cooling the bar of steel.

16. The process of claim 1, wherein the step of cooling the bar of steel comprises cooling the bar of steel in air for at least 10 min. and not greater than 20 min.

17. The process of claim 1, wherein the step of rinsing the bar of steel comprises rinsing the bar of steel in water for at least 15 minutes and not greater than 20 minutes.

18. The process of claim 1, wherein the step of cleaning the bar of steel comprises cleaning the bar of steel in water for at least 30 min.

19. The process of claim 1, wherein the oxide layers have a hardness of at least 68 HRC and not greater than 72 HRC.

20. The process of claim 1, wherein the diffusion layers have a hardness that is a gradient from about 68 to 72 HRC down to about 50 to 55 HRC based on proximity to the core.

21. The process of claim 1, wherein the oxide layers comprise iron, nitrogen, and oxygen compounds.

22. The process of claim 1, wherein the diffusion layers comprise nitrides and carbides.

* * * * *